US008833584B2

(12) United States Patent
Groubert

(10) Patent No.: US 8,833,584 B2
(45) Date of Patent: Sep. 16, 2014

(54) CLOSURE WITH UTENSIL RETENTION MECHANISM

(75) Inventor: Brian David Groubert, Boardman, OH (US)

(73) Assignee: Weatherchem Corporation, Twinsburg, OH (US)

( * ) Notice: Subject to any disclaimer, the term of this patent is extended or adjusted under 35 U.S.C. 154(b) by 0 days.

(21) Appl. No.: 13/539,879

(22) Filed: Jul. 2, 2012

(65) Prior Publication Data

US 2013/0001227 A1 Jan. 3, 2013

Related U.S. Application Data

(60) Provisional application No. 61/503,861, filed on Jul. 1, 2011, provisional application No. 61/511,766, filed on Jul. 26, 2011, provisional application No. 61/583,148, filed on Jan. 4, 2012.

(51) Int. Cl.

| | |
|---|---|
| ***B65D 51/00*** | (2006.01) |
| ***B65D 51/32*** | (2006.01) |
| ***A47G 19/18*** | (2006.01) |
| ***A47G 19/34*** | (2006.01) |
| ***B65D 47/08*** | (2006.01) |
| ***B65D 51/24*** | (2006.01) |

(52) U.S. Cl.

CPC ..... *B65D 47/0828* (2013.01); *A47G 19/186* (2013.01); *B65D 51/246* (2013.01); *B65D 47/0871* (2013.01)

USPC ..... 220/212; 220/735; 220/697; 220/574.1; 220/694; 206/229; 206/541; 206/230; 215/228; 215/390; 215/391; D7/392; D7/505

(58) Field of Classification Search

CPC .... B65D 51/00; B65D 51/246; B65D 21/022; B65D 83/00

USPC ..... 220/212, 735, 697, 574.1, 337; 206/541, 229, 542, 230; D9/717, 503; D7/392, 505, 436, 443, 538, 653

See application file for complete search history.

(56) References Cited

U.S. PATENT DOCUMENTS 1,257,057 A * 2/1918 White ..... 206/229
1,516,334 A * 11/1924 Clement ..... 141/380

(Continued)

FOREIGN PATENT DOCUMENTS

DE 3828330 * 2/1990 ..... B65D 41/16
FR 0708879 * 12/2007 ..... B65D 51/00

OTHER PUBLICATIONS

Final Office Action dated Aug. 15, 2013 for U.S. Appl. No. 13/539,890, 20 pages.

(Continued)

*Primary Examiner* — Mickey Yu
*Assistant Examiner* — Gideon Weinerth
(74) *Attorney, Agent, or Firm* — Amin, Turocy & Watson, LLP

(57) ABSTRACT

The disclosed aspects relate to a dispensing closure that comprises a utensil retention mechanism. The utensil retention mechanism can comprise at least two outward extending tabs that can be located on a lid portion of the dispensing closure. The at least two outward extending tabs can be positioned on the lid portion such that a section of a utensil can be securely engaged and retained by the at least two outward extending tabs. The dispensing closure can comprise a stay open mechanism, in an aspect. In another aspect, the dispensing closure can comprise a sift-resistance feature. In a further aspect, the dispensing closure can comprise a flex-lock.

19 Claims, 19 Drawing Sheets

(56) References Cited

U.S. PATENT DOCUMENTS

| | | | | | |
|---|---|---|---|---|---|
| 1,554,887 | A | * | 9/1925 | Smith | 220/735 |
| 1,607,863 | A | * | 11/1926 | Betts | 220/574 |
| 1,694,119 | A | * | 12/1928 | Frank | 141/381 |
| 2,789,608 | A | * | 4/1957 | Tupper | 220/792 |
| 2,942,752 | A | * | 6/1960 | Brunel | 220/212 |
| 3,272,368 | A | | 9/1966 | Van Baarn | |
| 3,312,366 | A | * | 4/1967 | Poris | 220/521 |
| 3,550,805 | A | * | 12/1970 | Leonforte | 220/212 |
| 4,010,875 | A | | 3/1977 | Babiol | |
| 4,158,902 | A | | 6/1979 | Chernack et al. | |
| 4,291,818 | A | | 9/1981 | Nozawa et al. | |
| 4,399,928 | A | | 8/1983 | Klingler | |
| 4,441,637 | A | | 4/1984 | Libit | |
| 4,753,367 | A | | 6/1988 | Miller et al. | |
| 4,887,747 | A | | 12/1989 | Ostrowsky et al. | |
| 5,088,612 | A | | 2/1992 | Storar et al. | |
| 5,090,572 | A | * | 2/1992 | DeRoseau | 206/542 |
| 5,145,088 | A | | 9/1992 | Goujon | |
| 5,251,758 | A | * | 10/1993 | Kolacek | 206/542 |
| 5,271,536 | A | | 12/1993 | Wilson | |
| 5,415,309 | A | * | 5/1995 | Wang | 220/4.27 |
| 5,529,205 | A | | 6/1996 | Corney et al. | |
| 5,706,974 | A | * | 1/1998 | Murdick et al. | 220/735 |
| 5,735,418 | A | | 4/1998 | Erb et al. | |
| 5,775,531 | A | * | 7/1998 | Lowry | 220/212.5 |
| D416,438 | S | * | 11/1999 | Molo | D7/392 |
| 6,021,903 | A | * | 2/2000 | Hanson | 206/541 |
| 6,138,863 | A | | 10/2000 | Aiken | |
| 6,415,965 | B2 | | 7/2002 | Nyman et al. | |
| 6,481,588 | B1 | | 11/2002 | Wagner | |
| 7,040,500 | B2 | | 5/2006 | Kipperman et al. | |
| 7,051,888 | B2 | | 5/2006 | Antier et al. | |
| 7,168,461 | B2 | * | 1/2007 | DeJonge | 141/22 |
| 7,175,041 | B2 | * | 2/2007 | Ekkert | 220/212 |
| 7,464,475 | B2 | * | 12/2008 | Tsao | 30/327 |
| 7,562,786 | B2 | * | 7/2009 | Morrison | 220/212 |
| 8,079,488 | B2 | * | 12/2011 | Darflinger | 220/212 |
| 8,087,530 | B2 | * | 1/2012 | Stevens | 220/212 |
| D661,588 | S | * | 6/2012 | Irani et al. | D9/503 |
| 8,302,805 | B2 | * | 11/2012 | Blomdahl et al. | 220/735 |
| 8,376,179 | B2 | * | 2/2013 | Horton et al. | 220/735 |
| 8,567,629 | B2 | * | 10/2013 | VanDamme et al. | 220/212 |
| 8,651,311 | B1 | * | 2/2014 | Drummond et al. | 220/212 |
| 8,695,838 | B1 | * | 4/2014 | Montgomery | 220/574.1 |
| 2005/0035122 | A1 | * | 2/2005 | Ekkert | 220/212 |
| 2006/0156811 | A1 | * | 7/2006 | Borowski et al. | 73/426 |
| 2006/0191948 | A1 | | 8/2006 | Wisniewski et al. | |
| 2010/0108670 | A1 | | 5/2010 | Perry et al. | |
| 2010/0264156 | A1 | * | 10/2010 | VanDamme et al. | 220/833 |
| 2010/0308065 | A1 | * | 12/2010 | Vandamme et al. | 220/697 |
| 2011/0174817 | A1 | * | 7/2011 | Blomdahl et al. | 220/212 |
| 2011/0192847 | A1 | * | 8/2011 | Vandamme | 220/315 |
| 2011/0315586 | A1 | * | 12/2011 | Horton et al. | 206/459.5 |
| 2012/0279964 | A1 | * | 11/2012 | McGeough | 220/212 |
| 2013/0081364 | A1 | * | 4/2013 | Piscopo | 53/492 |
| 2013/0134057 | A1 | * | 5/2013 | Horton et al. | 206/229 |

OTHER PUBLICATIONS

Office Action dated Dec. 5, 2013 for U.S Appl. No. 13/539,890, 37 pages.

Office Action dated Mar. 24, 2014 for U.S. Appl. No. 13/539,890, 41 pages.

* cited by examiner

CLOSURE WITH UTENSIL RETENTION MECHANISM

CROSS-REFERENCE

This application claims the benefit of U.S. Provisional Application Ser. No. 61/503,861, filed Jul. 1, 2011, entitled "CLOSURE WITH STAY OPEN FEATURE"; U.S. Provisional Application Ser. No. 61/511,766, filed Jul. 26, 2011, entitled "CLOSURE WITH STAY OPEN FEATURE"; and U.S. Provisional Application Ser. No. 61/583,148, filed Jan. 4, 2012, entitled "CLOSURE WITH UTENSIL RETENTION MECHANISM". The entireties of these applications are expressly incorporated herein by reference.

TECHNICAL FIELD

The following description relates generally to a closure and more particularly to a closure with a utensil retention mechanism.

BACKGROUND

Dispensing closures (sometimes referred to as caps or lids) can be utilized with containers (e.g., bottles, jars, cans, and so forth) as a single unit where the closure and the container are one piece or as separate units where the closure and the container are separate pieces. Further, the closures and containers can be used with a wide variety of products such as, for example, food items, powders, granular items, fertilizers, grass seed, and other non-food items, such as hardware (e.g., screws, nails, bolts, and so forth), and/or other items. The lack of an easy to use closure and/or poor dispensing of product from the container have been blamed for user dissatisfaction.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

An aspect relates to a closure comprising a body portion and a lid portion. The body portion can be configured to operatively engage a container. The lid portion can be operatively attached to the body portion. The lid portion can comprise a utensil retention mechanism, which can comprise a first projection and a second projection substantially parallel to the first projection. The utensil retention mechanism can also comprise a third projection located at a position that is substantially parallel the first projection and the second projection and oriented in an opposite direction than the first projection and the second projection. The first projection, the second projection, and the third projection can be configured to provide an interference fit with a utensil and engage the utensil.

Another aspect relates to a container assembly that can comprise a container and a dispensing closure attachable to the container. The dispensing closure can comprise a body portion comprising a skirt configured to operatively engage the container and a lid portion operatively attached to the body portion. The lid portion can comprise a first outward extending tab and a second outward extending tab substantially parallel to the first outward extending tab. The lid portion can also comprise a third outward extending tab offset from and facing an opposite direction than the first outward extending tab and the second outward extending tab.

A further aspect relates to a method that can comprise forming a body portion and a lid portion. The body portion can be attached to the lid portion with a living hinge. The method can also comprise forming, on the lid portion, a first projection and a second projection substantially parallel to the first projection. Further, the method can comprise forming, on the lid portion, a third projection located at a position that is offset and substantially parallel the first projection and the second projection and oriented in an opposite direction.

To the accomplishment of the foregoing and related ends, one or more aspects comprise features hereinafter fully described and particularly pointed out in the claims. The following description and annexed drawings set forth in detail certain illustrative features of one or more aspects. These features are indicative, however, of but a few of various ways in which principles of various aspects may be employed. Other advantages and novel features will become apparent from the following detailed description when considered in conjunction with the drawings and the disclosed aspects are intended to include all such aspects and their equivalents.

BRIEF DESCRIPTION OF THE DRAWINGS

Various non-limiting embodiments are further described with reference to the accompanying drawings in which.

DETAILED DESCRIPTION

Figure 1:
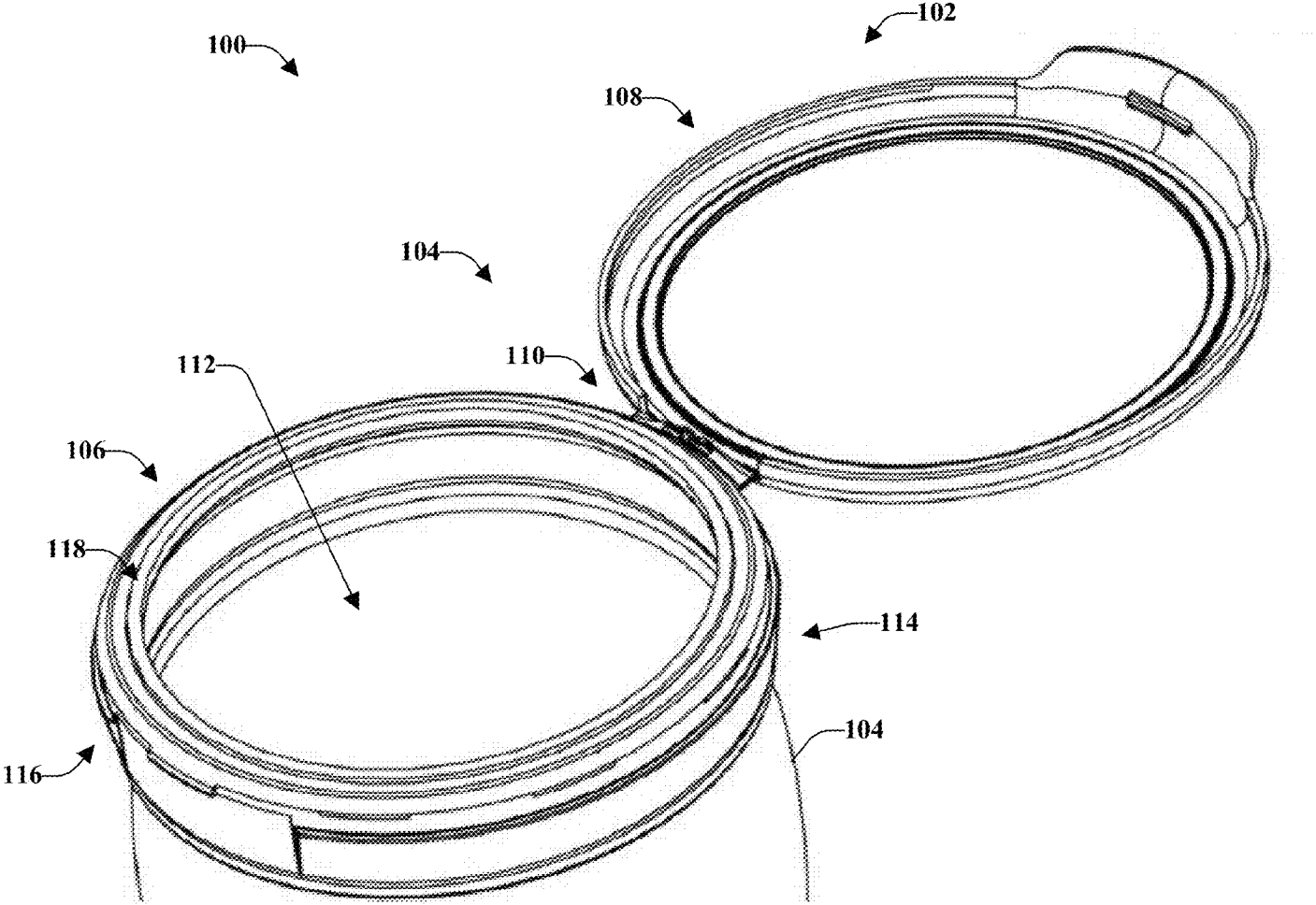
FIG. 1 illustrates an example of a non-limiting embodiment of a container assembly, according to an aspect.

Various aspects are now described with reference to the drawings, wherein like reference numerals are used to refer to like elements throughout. In the following description, for purposes of explanation, numerous specific details are set forth in order to provide a thorough understanding of one or more aspects. It may be evident, however, that the disclosed subject matter can be practiced without these specific details, or with other methods, components, materials, and so forth. In other instances, well-known structures and components may be shown in block diagram form in order to facilitate describing one or more of the aspects disclosed herein.

As discussed above, dispensing closure can be utilized with a vast variety of products, which can be in any number of forms. In some cases, such as with products that are in powder, granular, or liquid form, a utensil (e.g., a scoop, a measuring cup, a spoon, and so forth) might be used to dispense product from the container. For example, the container contents might need to be dispensed in a certain quantity (e.g., a tablespoon, a half a cup, and so forth). Thus, in order to dispense the product, a person obtains an appropriate sized utensil (or one is provided with the product) and dispenses the product according to the serving size (or other desired size).

In an example, for ease of dispensing coffee (or other item), a person might use a scoop (or a different type of utensil), to measure the proper amount of coffee. The utensil is inserted, at least partially, into the coffee and the coffee is removed from the container and used as desired. When finished dispensing the coffee, the person might drop the scoop into the container, which can cause the scoop to come in contact with the coffee remaining in the container. This can be unsanitary, especially in the case where many different persons might use the scoop (e.g., in an office situation). Thus, the coffee remaining in the container can become contaminated. Further, some of the coffee (or other product) can contaminate the scoop, and when used again, a person's fingers can become soiled with the product.

In the case where the utensil cannot be placed in the container (e.g., for liquid products), the utensil might be placed next to the container (e.g., on the same shelf on which the container is stored) or at a different location (e.g., in a drawer). However, the utensil might be moved or might fall to the floor, which can contaminate the utensil. Thus, when a person desires to dispense an additional amount of the product, the utensil might not be in the expected location (e.g., next to the container) or might not be suitable for use (e.g., contaminated with dirt due to falling on the floor). This can create frustration and waste time because the person has to locate the lost utensil, obtain a different utensil, and/or clean the utensil.

An aspect disclosed herein relates to a closure that can comprise a utensil retention mechanism that can be configured to securely engage and retain a utensil in a lid of the closure. Additionally or alternatively, the closure can comprise a lid stay open mechanism that can be configured to retain the lid of the closure in an open position, allowing convenient, easy access to the container contents.

Turning to the figures, FIG. 1 illustrates an example, non-limiting embodiment of a container assembly 100, according to an aspect. The container assembly 100 can comprise a dispensing closure 102 and a container 104. The dispensing closure 102 can be a lid or cap or another mechanism that secures an opening of the container 104. The closure and container can be operatively attached in a removable or non-removable manner. The container 104 can be a bottle, a jar, and so forth. In an implementation, the container assembly 100 can be a sealable container assembly (e.g., waterproof, spill proof, and so forth).

Although the illustrated closure has a particular size and shape, the disclosed aspects are not limited to this embodiment. Instead, the closure can be any size or shape and the closure illustrated is for example purposes only. Further, the container, on which the closure can be operatively attached, can also be any shape or size, which can be selected as a function of contents or product that is to be stored in the container. Examples, of container contents can include powder, granular items, solid or semi-solid contents including food items (e.g., ketchup, mustard, baby food, spices, cookies, cereal, peanuts, grains, and so forth) and non-food items, such as hardware (e.g., nuts, bolts, nails, fasteners, screws) as well as other items (e.g., rock salt, grass seed, sand, and so on). In another example, the container contents can be liquid or semi-liquid contents (e.g., water, orange juice, automotive oil, rubbing alcohol, and so forth). Other examples of container contents can include medicine (e.g., pharmaceutical products) and cosmetics. The container contents that can be utilized with the disclosed aspects are many and, therefore, will not be further discussed herein.

The closure and container can be the same color or can be different colors. For example, the container can be clear and the closure can be colored (opaque). In another example, both the container and the closure can be clear or both can be formed of colored material (e.g., blue, red, yellow, and so forth). In accordance with some aspects, the closure and the container can be made of the same material or of a similar material. According to other aspects, the closure and the container are formed of different materials. In an implementation, the container and/or the closure can be formed of a polymer material. According to some implementations, the closure and/or the container can be formed of an injection molded suitable thermoplastic material (e.g., polymer, polypropylene) or other material known in the art.

The closure 102 is illustrated as a unitary (e.g., a one-piece) structure having a first portion (e.g., a body portion 106) configured to engage the neck of the container and a second portion (e.g., a lid portion 108) configured to be movable with respect to the first portion. However, in accordance with some aspects, the dispensing closure can be formed as a multiple piece structure (e.g., operatively connected at a hinge 110). As previously mentioned, although the various aspects are illustrated as a generally circular dispensing closure and/or container, the various aspects are not limited to this implementation. In accordance with some aspects, the dispensing closure and/or container can have a different geometric shape (e.g., oval, oblong, and so on).

As mentioned, the lid portion 108 can be movable. For example, the lid portion 108 can be configured to move between a first position (e.g., closed position) and a second position (e.g., open position). For example, the lid portion 108 can be configured to selectively engage the body portion 106 (e.g., first position or closed position) and can be further configured to move away from the body portion 106 (e.g., second position or open position), as shown in FIG. 1. When the lid portion 108 is in the open position, as illustrated, contents (not shown) of the container 104 can be accessed or dispensed.

In an implementation, the lid portion 108 can be configured to, at least temporarily, seal the container 104 such that contents of the container 104 cannot be accessed. Thus, the closure 102 can be moved into its first position for spill-proof purposes and/or for safety purposes (e.g., seals the product within the container, provides an indication that contents of the container might have been tampered with, and so forth). Further, the movable lid portion 108 can be configured to provide easy access to the container and container contents (e.g., through a flip open feature), wherein container contents can be accessed without completely removing the closure from the container.

With continuing reference to FIG. 1, the container 104 comprises an opening or container mouth. The closure 102 (e.g., body portion 106) can be configured to engage a neck (e.g., an upper rim) of the container, wherein the container neck comprises an outer boundary or outer perimeter of the mouth. When in engagement with the container, an opening 112 of the body portion 106 corresponds to the container mouth such that container contents can be dispensed through the container mouth and the opening 112.

According to an aspect, the body portion 106 comprises an end wall 114. According to some aspects, the end wall can be generally circular, however, other configurations are possible with the disclosed aspects. A hollow or tubular skirt 116 depends from the end wall 114. The skirt can be generally cylindrical or a different shape, which can be a function of the shape of the end wall.

The skirt can be configured to engage with the container 104. For example, the skirt can engage with a mouth of the container in a threaded manner or in a non-threaded manner For example, the skirt 114 can include internal screw threads that can operatively engage with complementary screw threads on a neck of the container. According to some aspects, internal threads are not utilized and the dispensing closure is engaged with the container through other means (e.g., snap-on, press-on, and so forth). For example, the closure can operatively engage the container by snapping onto the neck portion of the container (e.g., screw threads are not utilized). However, other means of engaging the closure and the container can be utilized with the disclosed aspects. In an aspect, the container and closure can be a two-piece structure. According to some aspects, the container and the closure are formed as a single piece or single unit. Further, the dispensing closure can engage the container in a removable manner or in a non-removable manner.

Figure 2:
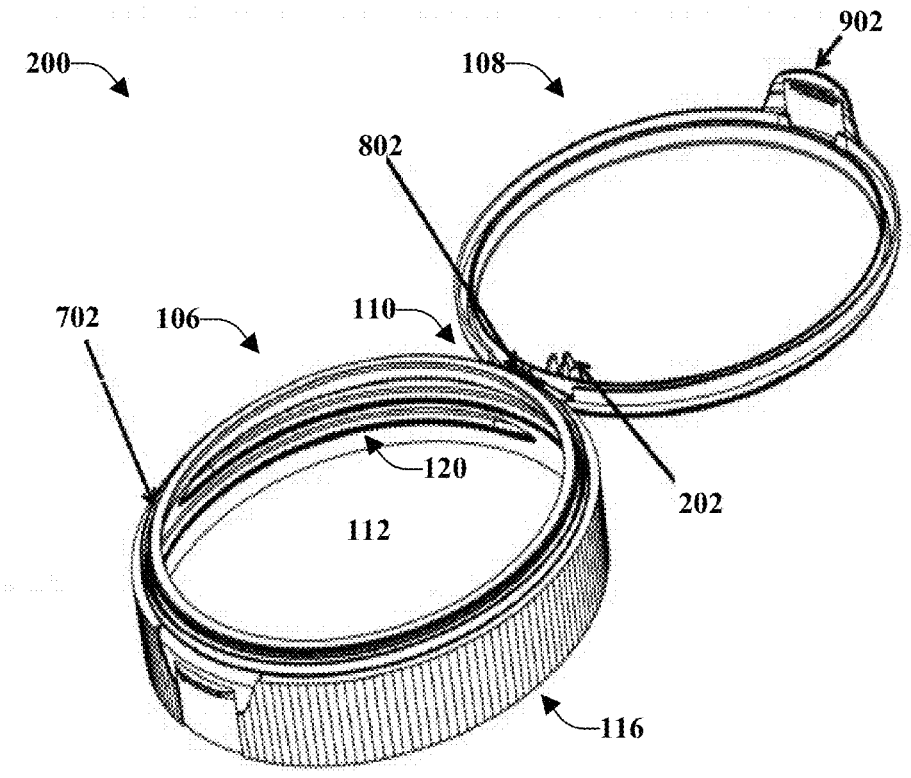
FIG. 2 illustrates an example, non-limiting embodiment of a dispensing closure, according to an aspect.

An exterior portion of the skirt can be smooth. In another implementation, as shown in FIG. 2 an exterior portion of a skirt can comprise small vertical grooves or other textural features that can improve a person's ability to grip the dispensing closure for removal from the container (e.g., by unscrewing, by pulling the dispensing closure away from the container, and so on).

The end wall 114 can be formed with a lip 118 according to some aspects. The lip 118 can define the size of the opening 112 of the body portion 106. In an implementation, the opening can be sized to provide full open dispensing capabilities (e.g., the same size as a mouth of the container, about the same amount of dispensing capability as would be provided were the dispensing closure removed from the container). Providing full open dispensing capabilities, without requiring removal of the dispensing closure from the container, provides ease of use and dispensing. Thus, the full-open dispensing capability provides the advantage of not requiring a user to remove the dispensing closure from the container to achieve the same or similar results that would be achieved if the closure were removed from the container.

A dispensing closure can be installed upright on the top of a container that has a mouth that typically lies in a horizontal plane. For purposes of discussion, the vertical direction generally corresponds to an axial direction with reference to the geometry of the dispensing closure and the horizontal direction or horizontal plane is perpendicular to the axial direction of the dispending closure (e.g., the vertical direction). It should be understood that during molding, the dispensing closure could have a non-upright orientation.

The lid portion is pivotally joined to the end wall by, for example, the hinge 110. The hinge can be a "living hinge", a "pivoting hinge", or another type of hinge. A living hinge is a hinge formed with the body portion and the lid portion as a single piece. A pivoting hinge is formed with the body portion (or the lid portion), wherein the body portion and lid portion are formed as separate pieces and snapped together at the hinge to combine the two pieces. The hinge lies in a plane perpendicular to the axis of the skirt. The hinge allows for ease of moving the lid portion, between the first position and the second position. When in the first position, the lid portion is closed over the body portion and product cannot be dispensed from the container (e.g., for storage purposes). When in the second position, the lid portion is "open" (or moved away from the body portion), which allows product to be dispensed in a full-open manner (e.g., an end user can insert their hand into the container to dispense product.

According to some aspects, the hinge can be constructed of a relatively thin wall that is configured to flex without breakage during an expected service life of the dispensing closure. The hinge allows the lid portion to be moved away from the body portion (e.g., flipped up, placed into the second position) for dispensing in a "full open" manner. The hinge also allows the lid portion to be moved into contact with the body portion (e.g., placed into the first position) for dispensing in a non-full open manner (e.g., in a pourable manner) or for storage purposes.

FIG. 2 illustrates an example, non-limiting embodiment of a dispensing closure 200 that comprises a utensil retention mechanism, according to an aspect. In this implementation, the closure 200 can comprise a utensil (or scoop) retention mechanism 202 that can be configured to operatively engage and retain a utensil (e.g., an item that can be utilized to remove product from the container). For example, the utensil retention mechanism 202 can be configured to retain utensils of different sizes, shapes, or lengths as will be described further below. The utensil retention mechanism 202 can be configured such that a utensil can clip on the inside of the lid portion of the container, which can provide end users a simple and effective solution for measuring powder products, granular products, or other products.

Figure 3:
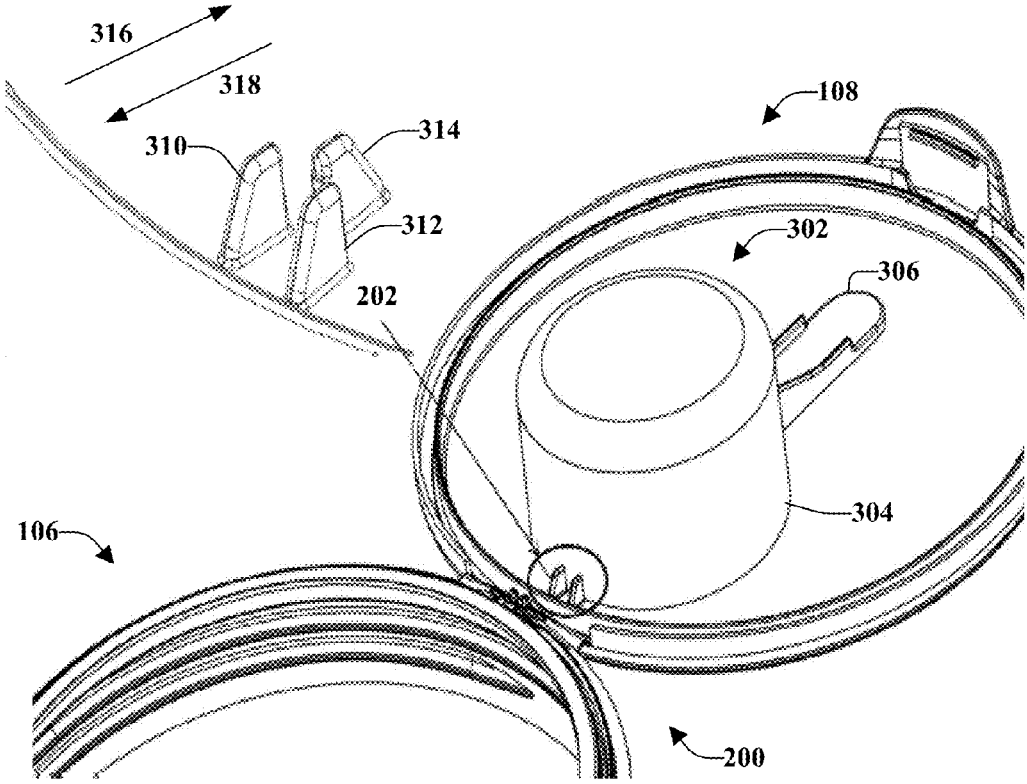
FIG. 3 illustrates a non-limiting example of a utensil retained by the dispensing closure according to an aspect.

FIG. 3 illustrates a non-limiting example of a utensil retained by the example closure 200 according to an aspect. As illustrated, the utensil can be a scoop 302 having a cup portion 304 and a handle portion 306 operative attached to the cup portion 304. Although illustrated as a generally circular scoop 302, other configurations of a scoop (or other utensil) can be utilized according to the various aspects presented herein. For example, the utensil can be substantially rectangular, oblong, cuboid, cylindrical, or another geometric configuration (e.g., shapes) or combination of geometric configurations (e.g., a first portion of the utensil is substantially circular and a second portion of the utensil is substantially rectangular). Further, in some aspects, the utensil can be one of many different sizes, wherein the utensil is sized to be operatively retained on an internal portion of the lid of the closure 200.

Although the utensil (e.g., scoop 302) is illustrated and described as having a handle portion, the disclosed aspects are not limited to a utensil having a handle portion and it should be understood that the utensil does not need to incorporate a handle. Further, in the aspects in which the utensil comprises a handle, the handle can be located at a different location than the location shown and described. In accordance with some aspects, the handle is integrated with the utensil and does not protrude substantially away from the cup portion of the utensil. Further, in some aspects, the utensil can comprise a spout, a pourable portion, and/or other features.

An exploded view of the utensil retention mechanism 202 is illustrated in the upper left of FIG. 3. The scoop retention mechanism 308 is integrated with the lid portion of the closure. In an implementation, the scoop retention mechanism 308 can comprise at least two tabs (e.g., projections or prongs). Illustrated in FIG. 3 is a utensil retention mechanism 202 that comprises three projections. However, in another implementation, a utensil retention mechanism can comprise two projections. In accordance with some aspects, more than one scoop retention mechanism can be utilized. In further aspects, placement of the scoop retention mechanism can be at an interior location of the lid portion that is different than the placement illustrated and described herein.

The at least two tabs can be outward extending tabs, wherein the tabs extend outward from the lid portion 108. Further, the outward extending tabs can be located on an internal portion of the lid portion 108, whereby when the lid portion 108 is closed (e.g., engaged on or over the body portion 106), the utensil is accommodated within an opening or mouth of the closure and/or container. Further, the placement of the utensil retention mechanism should be located so that the utensil does not interfere with closure of the dispensing closure.

As illustrated, the example of FIG. 3 comprises three tabs or projections. A first tab 310 and a second tab 312 can face a first direction, illustrated by arrow 316, and a third tab 314 can face a second direction, illustrated by arrow 318, which is substantially opposite the first direction. The placement of the three tabs can be configured such that at least a portion of the utensil can be operatively engaged and secured within or between the three tabs. For example, a first portion of the utensil (e.g., an external portion of the scoop) can be substantially in contact with the first tab 310 and the second tab 312 and a second portion of the utensil (e.g., an internal portion of the scoop) can be substantially in contact with the third tab 314. In an aspect, the utensil can be secured such that when the lid portion is placed in a closed position (e.g., closed over the body portion), the utensil remains engaged with the projections and does not fall into the interior of the container. Thus, when the lid portion 108 is moved to an open position, the utensil is also moved away from the container and can be easily accessed.

Figure 4:
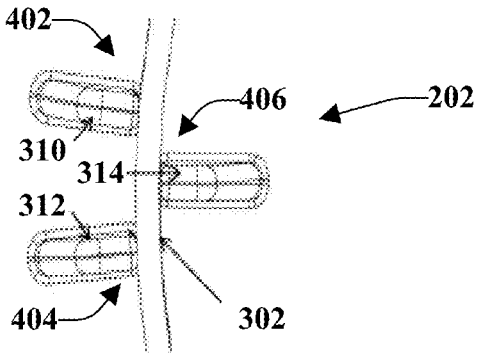
FIG. 4 illustrates a top down exploded view of the scoop retention mechanism, according to an aspect.

With reference now also to FIG. 4, which illustrate a top down exploded view of the utensil retention mechanism 202, according to an aspect. As illustrated, the example utensil retention mechanism 202 comprises three outward extending tabs that provide an interference fit with the scoop. A first tab 310 and a second tab 312 are disposed on the lid portion and are substantially parallel each other. Although it is indicated that the first tab 310 and second tab 312 are substantially parallel, it should be understood that the tabs can angled slightly (or dramatically) away from each other, as illustrated in FIG. 4. Such angling of the tabs can be utilized to accommodate a utensil that has a slightly curvature shape (or that comprises another shape) or can hold multiple arcs. It should be noted that different configurations of the outward extending tabs could be utilized to accommodate utensils having a different geometric shape (e.g., square, rectangular, and so forth).

Also included in the example utensil retention mechanism 202 is a third tab 314 that is substantially offset but parallel to the first tab 310 and the second tab 312. For example, the third tab 314 can be placed in an opposite configuration from the first tab 310 and the second tab 312. Thus, the third tab 314 can be placed such that its orientation is about 180 degrees different from the orientation of the first tab 310 and the second tab 312. For example, as best viewed in FIG. 4, a first end 402 of the first tab 310, a first end 404 of the second tab 312, and a first end 406 of the third tab 314 can be configured to engage the scoop 302. For example, the third tab 314 can be located away from respective ends of the first tab 310 and the second tab 312 at a distance selected as a function of a thickness of the utensil or scoop 302.

The first ends of each of the tabs can be configured to securely engage the utensil. For example, the three tabs (or a different number of tabs) can be configured to provide an interference fit with the utensil. In accordance with some aspects, the tabs or projections can be configured to securely engage one or more utensil sizes or lengths. Additionally or alternatively, the tabs or projections can be configured to securely engage utensils that have a different shape (e.g., generally circular, generally rectangular, and so forth). As previously discussed, more than one scoop retention feature can be utilized (e.g., to accommodate a larger utensil and/or to accommodate more than one utensil).

In an implementation that utilizes two tabs, the tabs can be almost directly offset from each other such that a utensil is engaged substantially between the two tabs. In an implementation that uses more than three tabs, the orientation of the tabs can be configured such that at least a portion of the utensil is engaged between the tabs. The number of tabs utilized can be based on the size or weight of the utensil.

Figure 5:
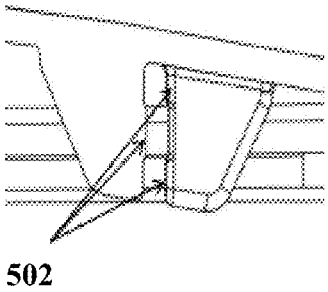
FIG. 5 illustrates a close-up view of one of the tabs illustrating an emboss on feature, according to an aspect.

FIG. 5 illustrates a close-up view of one of the tabs illustrating an emboss on feature 502, according to an aspect. Each of the tabs can comprise the emboss on feature 502 to help retain the utensil in secure engagement on the interior portion of the lid, in accordance with some aspects. For example, the utensil can be a scoop that can be a cup with a wall thickness of around 1 mm. The offset emboss can allow for some deformation of the wall of the tab, which can create a higher retention force, according to an aspect.

Figure 6:
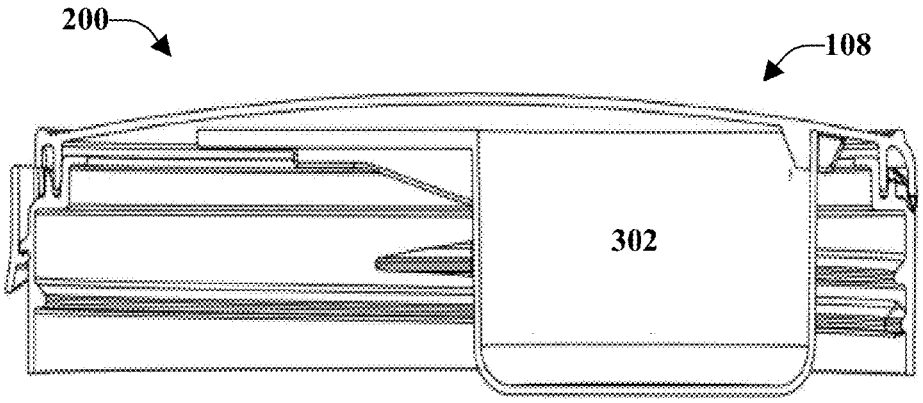
FIG. 6 illustrates a cut-away view of the dispensing closure with the scoop retained in secure engagement with the lid portion, in accordance with an aspect.

FIG. 6 illustrates a cut-away view of the closure 200 with the scoop 302 retained in secure engagement with the lid portion 108, in accordance with an aspect. The scoop 302 can be placed in the illustrated position by the end user (e.g., consumer) after product has been dispensed. For example, the end user can purchase the container, having the desired product therein. The end user opens the container by, for example, removing a freshness or safety liner. The utensil can be included on top of (or slightly within) the container contents. In an implementation, the scoop can be provided attached to the lid portion as illustrated. After dispensing the product (or at a different time), the end user can insert at least a portion the scoop into the tabs (as previously discussed) in order for the scoop to be engaged with the lid, thereby mitigating the chances of the scoop coming into contact with the product that has not been dispensed from the container. This can mitigate contamination of the product and/or loss of the utensil, for example.

Figure 7:
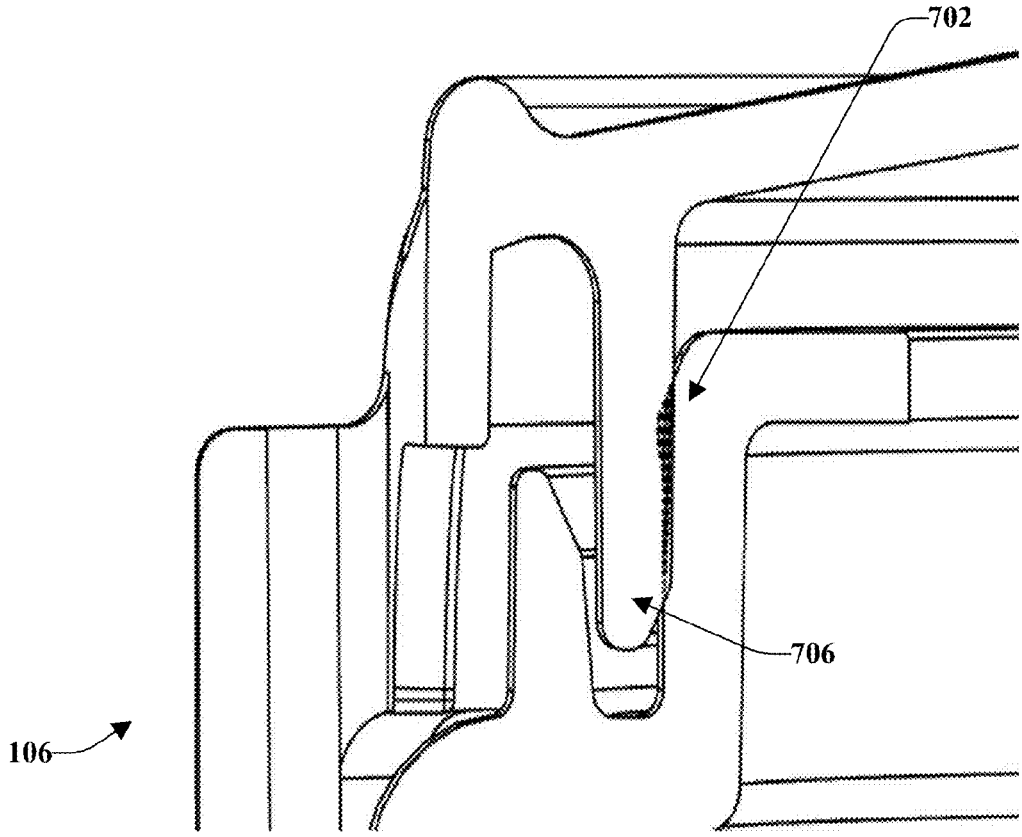
FIG. 7 illustrates a dispensing closure comprising a sift resistance element, according to an aspect.

With reference now to FIGS. 2 and 7, additionally or alternatively, the closure 200 can comprise a sift resistance element 702 that can be configured to mitigate contents of the container from escaping from the container, such as when the container is knocked over on its side or is inverted (accidently or purposefully). As illustrated, the body portion 106 comprises a connector 704 and the lid portion 108 comprises a mating element 706. The mating element 706 can be configured to selectively engage the connector 704. For example, the connector 704 can comprise a "U"-shaped member that can be configured to substantially enclose at least a portion of the mating element 706. The engagement of the connector 704 and the mating element 706 can mitigate powder or granular material from escaping through the dispensing closure. Although discussed as a "U"-shaped member, other configurations can be utilized where the connector 704 and the mating element 708 are of substantially the same shape (or a similar shape) which can allow the connector 704 to substantially encase at least a portion of the mating element 706.

Figure 8:
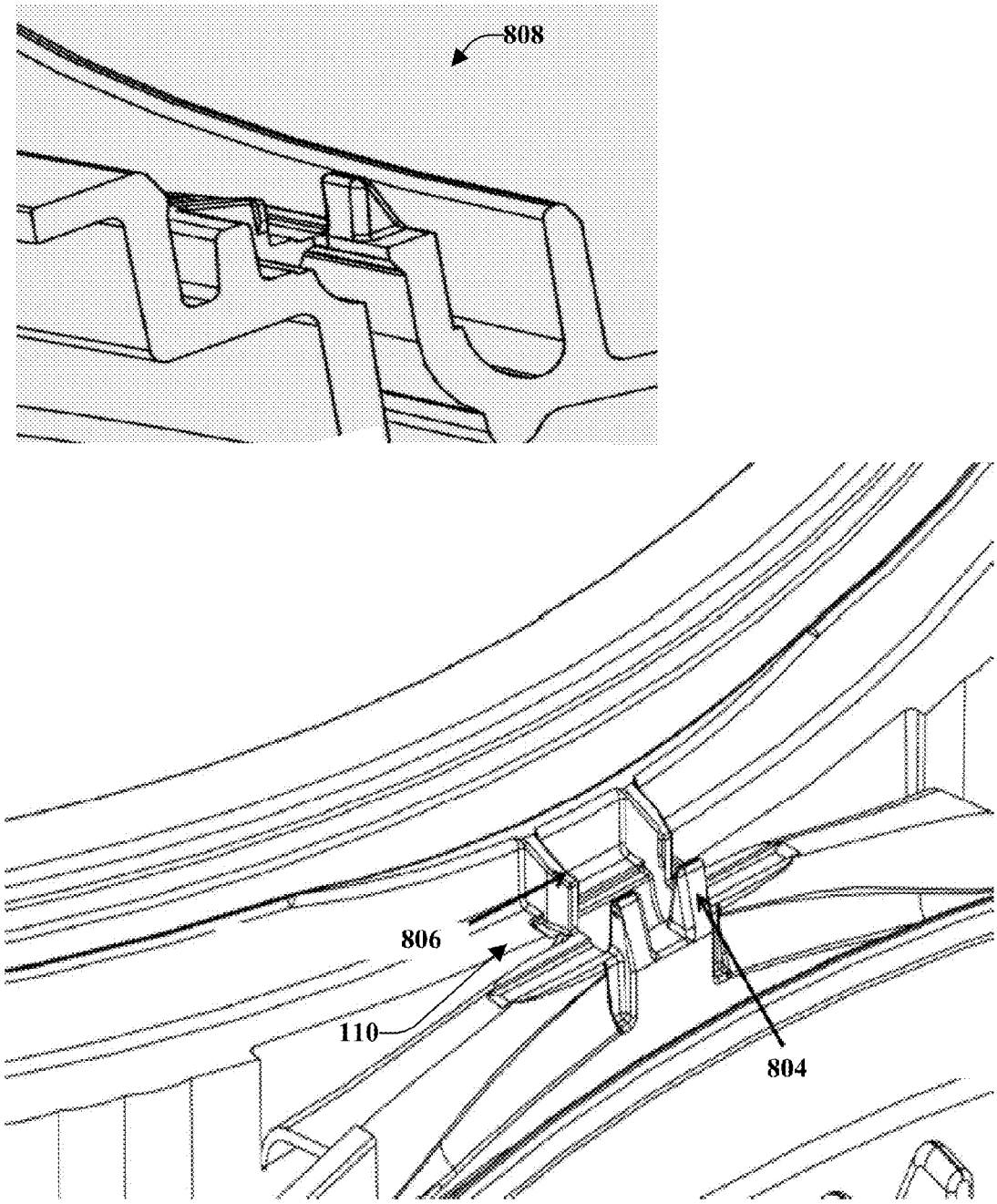
FIG. 8 illustrates a dispensing closure comprising a lid stay open mechanism, according to an aspect.

With reference now to FIGS. 2 and 8, according to some aspects, alternatively or in addition to the utensil retention mechanism 202 and/or the sift resistance element 702, the closure 200 can comprise a lid stay open mechanism 802. According to this implementation, the body portion 106 comprises at least one flex element 804 (also referred to as a first stop section). In an aspect, the flex element 804 can be configured to stop rotation of the lid portion 108 about an axis of rotation. The lid portion 108 can comprise at least one lid stop element 806 (also referred to as a second stop section). As illustrated, the flex element 804 and the lid stop element 806 can be located adjacent a hinge 110 that can be configured to operatively connect the body portion 106 and the lid portion 108. The lid stop element 806 can be configured to move about the axis of rotation. In an aspect, the lid stop element 806 can be configured to move about the flex element 804 and around the axis of rotation (e.g., is movable as the lid portion 108 is moved between the first position and the second position). Further to this aspect, the movement of the lid stop element 806 about the axis of rotation creates an interference with the flex element 804. For example, at least a portion of the lid stop element 806 and at least a portion of the flex element 804 can contact each other when the lid portion is in the second position (e.g., open). In accordance with some aspects, an interference between the lid stop element 806 and the flex element 804 can create a designed-in interference. The interference can be configured to retain the lid portion in an open position (e.g. stay open configuration).

In accordance with some aspects, engagement of the flex element 804 and the lid stop element 806 can be configured to retain the closure 200 (e.g., lid portion 108) in an open position (e.g., dispensing position). The engagement can be created when the lid portion 108 is moved in a first direction (e.g., in a direction away from the container and the body portion 106 or to its open position). In an aspect, the engagement of the flex element 804 and the lid stop element 806 can create interference in order to retain the lid portion 108 in the open position. In such a manner, the lid portion stays open and the user can access the container contents easily and without needing to hold open the lid. Force applied to the lid portion 108 in a second direction (e.g., toward the container and body portion 106 or into its closed position) can overcome the interference. The force, applied in the second direction, causes the lid portion 108 to rotate about the hinge axis to a closed position. As illustrated, at 808, the stay open mechanism can have a low profile and, therefore, does not add bulk to the closure 200. Further details related to the stay open mechanism will be provided below.

Figure 9:
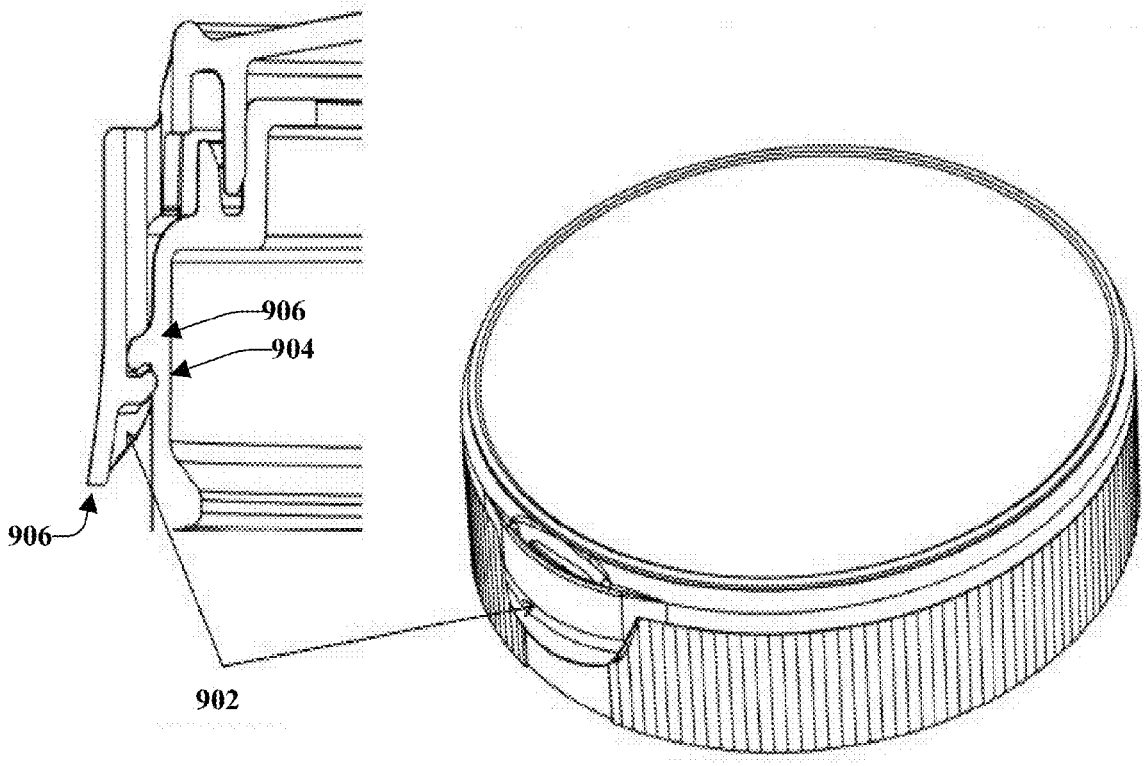
FIG. 9 illustrates a dispensing closure comprising a flex lock mechanism, in accordance with an aspect.

With reference to FIGS. 2 and 9, additionally or alternatively, the closure 102 can comprise a flex lock mechanism 902. The flex lock mechanism 902 can be a positive lock that securely retains the dispensing closure in a closed position (e.g., lid portion is engaged with the body portion). The flex lock mechanism 902 can mitigate the lid portion from moving away from the body portion due to vibrations or other causes. As illustrated in FIG. 9, the flex lock mechanism 902 can comprises a first element 904 that can securely engage a second element 906. The first element 804 can be located on the lid portion and the second element 906 can be located on the body portion.

In order for the dispensing closure to be opened, the first element 904 should be moved away and disengaged from the second element 906. For example, a bottom portion 908 of the flex lock mechanism 902 can be pulled away from the container. In an implementation, an end user can place their finger between the container and the bottom portion 908 and pull outward, away from the container.

Movement of the bottom potion 908 away from the container can cause the first element 904 to disengage from the second element 906. For example, the outward movement of the bottom portion 908 can cause at least a portion of the flex lock mechanism 902 to bend, which can cause the first element 904 to bend slightly downward and away from a mating portion of the second element 906. Motion in substantially the opposite direction (e.g., pushing the bottom portion 908 toward the container) can cause the first element 904 to engage with the second element 906, thereby retaining the closure in the closed position.

As discussed above, the size of the container and the container mouth (e.g., portion of the container to which the dispensing closure engages) can be a function of the size of the contents to be stored in the container. If the contents are large or should be dispensed in large quantities, the container, the container mouth, and the dispensing closure can be large. On the other hand, if the contents are small and/or should be dispensed in small quantities, the container mouth and dispensing closure can be small.

Further, the dispensing closure can include components, such as a flap or lid (e.g., lid portion) that can be flipped away from a main portion (e.g., body portion) of the dispensing closure in order to access contents of the container. The flipping or pivot action can provide access to the container contents without the need to completely remove the dispensing closure from the container (e.g., allowing access to the container contents with minimal effort). However, in some cases, the flip-top portion of the closure might interfere with dispensing of the product. For example, the flip-top portion might close slightly while the product is being dispensed and, therefore, the user has to reopen the closure or move the closure away from the dispensing opening while product is being dispensed. In another example, the user might need to hold the closure open with one hand, while dispensing product from the container with the other hand, which can be cumbersome.

An alternative or additional implementation relates to a closure that includes a stay open mechanism. The stay open mechanism can allow a movable portion of the closure (or lid) to be moved away from a dispensing opening of a container and held in the open position (or a partially open position). The stay open mechanism can provide for ease of dispensing product from the container. Further, the stay open mechanism can facilitate one hand operation for ease of opening and closing the container lid. In another example, the stay open mechanism can mitigate an amount of spillage of the container contents and/or less mess when dispensing a product. The closure 102 of FIG. 1 includes a stay open mechanism, which comprises a low profile (e.g., does not substantially extend away from the main portion of the container.

Figure 10:
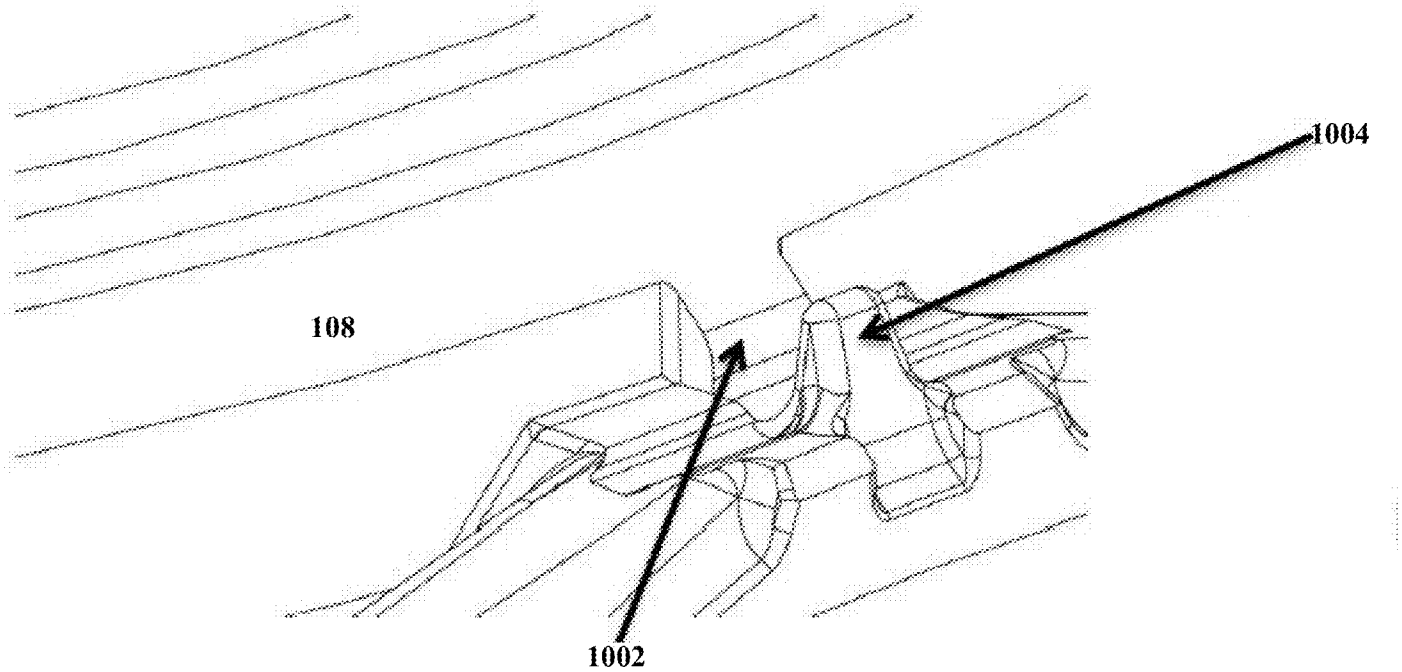
FIG. 10 illustrates an exploded view of a portion of a dispensing closure comprising a body stop element and a lid stop element, according to an aspect.

With reference to FIG. 10, illustrated is an exploded view of a portion of the dispensing closure of FIG. 1, when the dispensing closure is in a full open position, according to an aspect. The exposed view is an area of the area that includes the hinge. In this implementation, the body portion 106 comprises at least one first stop section 1002 (e.g., a flex element). In an aspect, the first stop section 1002 can be configured to operate as a cam to stop rotation of the lid portion 108 about a hinge axis 1102, illustrated in FIG. 11.

Figure 14:
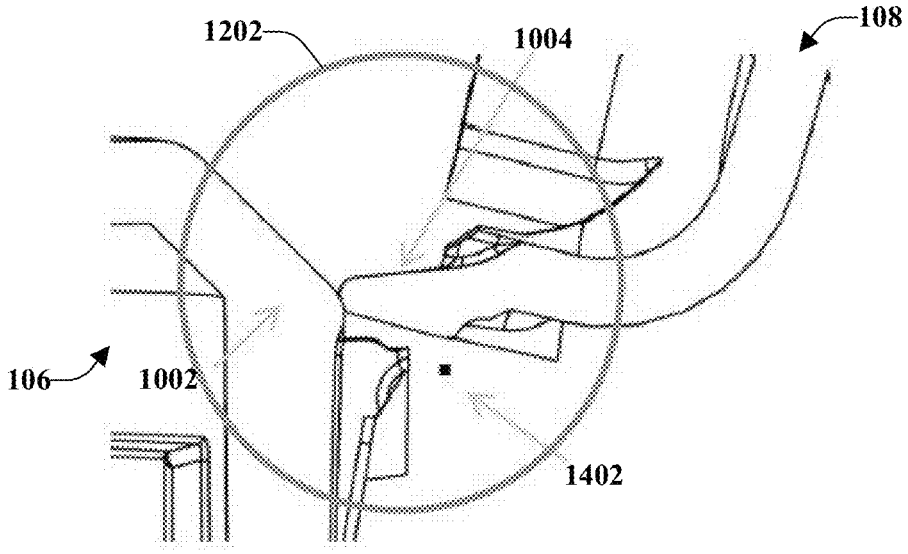
FIG. 14 illustrates an exploded view of a portion of the dispensing closure of FIG. 4, when the dispensing closure is in a stay open position, according to an aspect.

The lid portion 108 comprises at least one second stop section 1004 (e.g., a lid stop element). As illustrated in FIGS. 12-16 (where FIGS. 13-16 are exploded views of the indicated section 1202 of FIG. 12), the first stop section 1002 and the second stop section 1004 are located adjacent the hinge 110. The second stop section 1004 can be configured to move about an axis of rotation 1402 (FIG. 14). For example, the second stop section 1004 moves with the lid portion 106 around the axis of rotation.

In an aspect, the second stop section 1004 can be configured to move about the first stop section 1002 at the axis of rotation 1402 (FIG. 14). Further to this aspect, the movement of the second stop section 1004 about the axis of rotation 1402 can create an interference 1602 (FIG. 16) with the first stop section 1002. The interference 1602 between the second stop section 1004 and the cam-like feature on the body of the closure (e.g., first stop section 1002) can be a designed-in interference. As illustrated, the interference can be caused by at least a portion of the first stop section touching at least a portion of the second stop section 1004.

Figure 15:
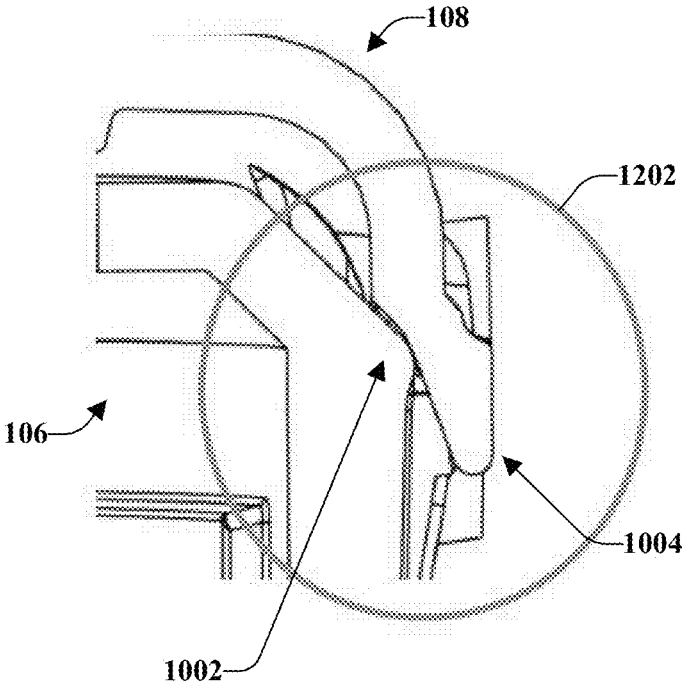
FIG. 15 illustrates an exploded view of a portion of the dispensing closure of FIG. 4, when the dispensing closure is in a closed position, according to an aspect.
Figure 16:
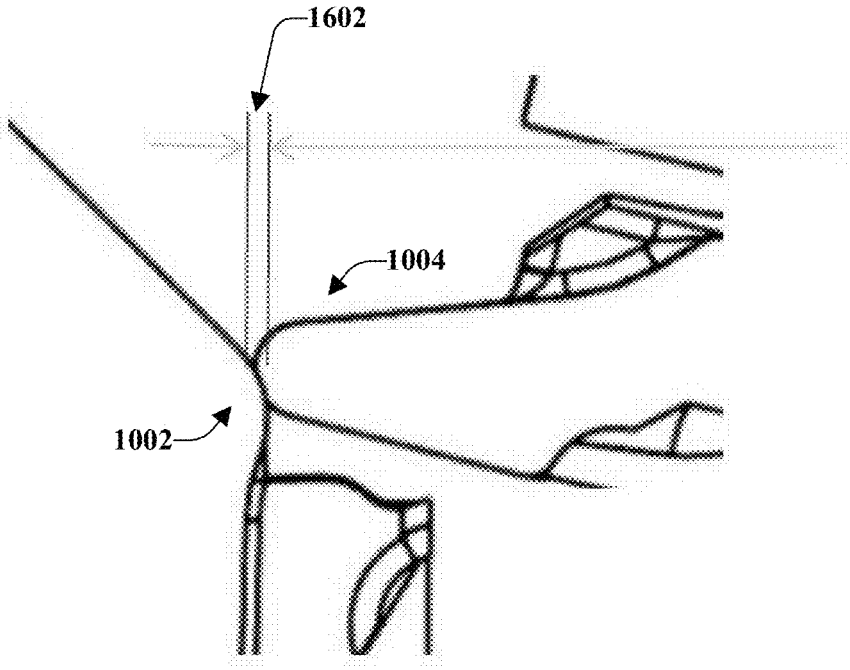
FIG. 16 illustrates an interference created between a body stop element and a lid stop element of a dispensing closure, according to an aspect.

In accordance with some aspects, engagement of the first stop section 1002 and the second stop section 1004 can be configured to retain the closure 1000 (e.g., lid portion 108) in an open position. The engagement can be created when the lid portion 108 is moved in a first direction (e.g., in a direction away from the container 104 and the body portion 106). In an aspect, the engagement of the first stop section 1002 and the second stop section 1004 creates interference in order to retain the lid portion 108 in the open position (or in at least a partially open position). According to some aspects, the engagement of the first stop section 1002 and the second stop section 1004 can create interference and force applied to the lid portion 108 in a second direction (e.g., toward the container 104 and body portion 106) can overcome the interference. For example, the force, applied in the second direction, causes the lid portion 108 to rotate about the hinge axis 1102 to a closed position (as shown in FIG. 15). As illustrated in FIG. 15, when the lid portion 108 is in the closed position, the first stop section 1002 and the second stop section 1004 do not protrude away from the closure 102 (e.g., outside of package).

Figure 11:
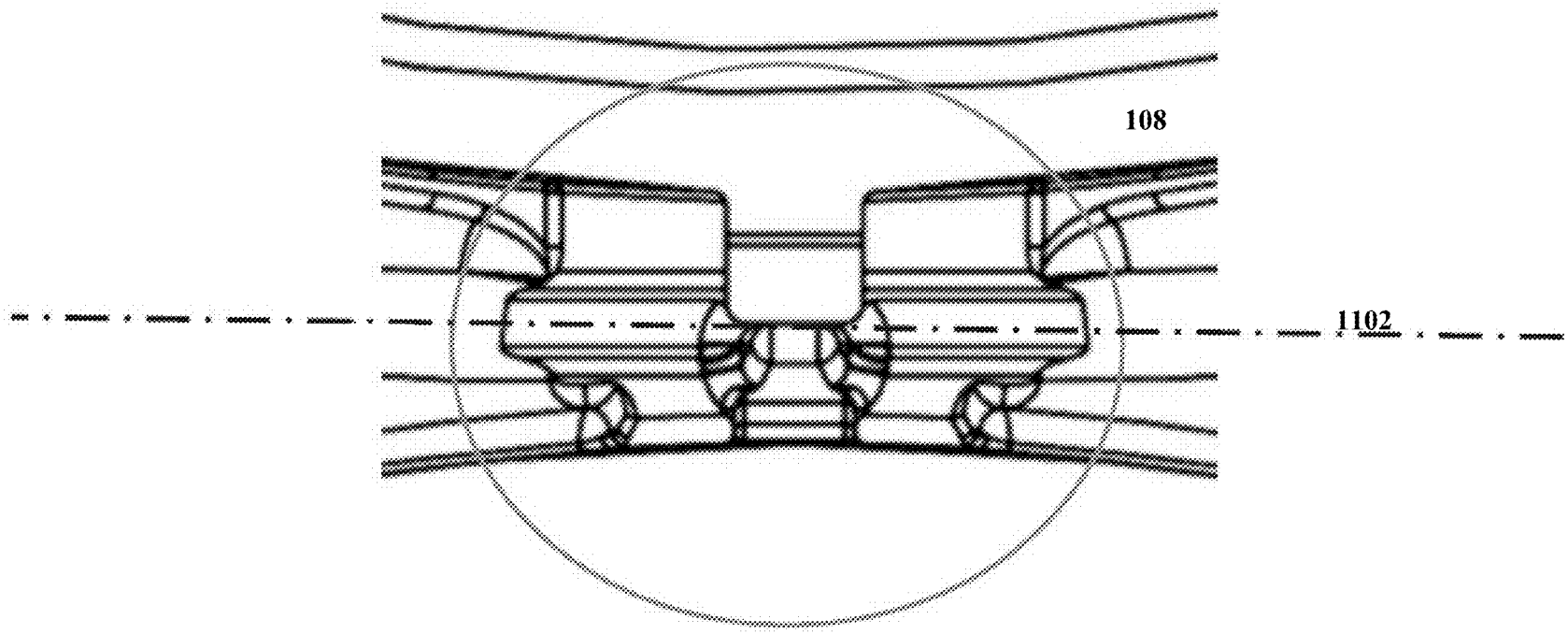
FIG. 11 illustrates a hinge axis of a dispensing closure, according to an aspect.
Figure 12:
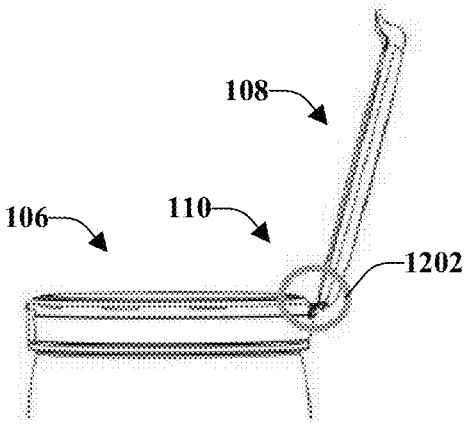
FIG. 12 illustrates a dispensing closure in an open position, according to an aspect.
Figure 13:
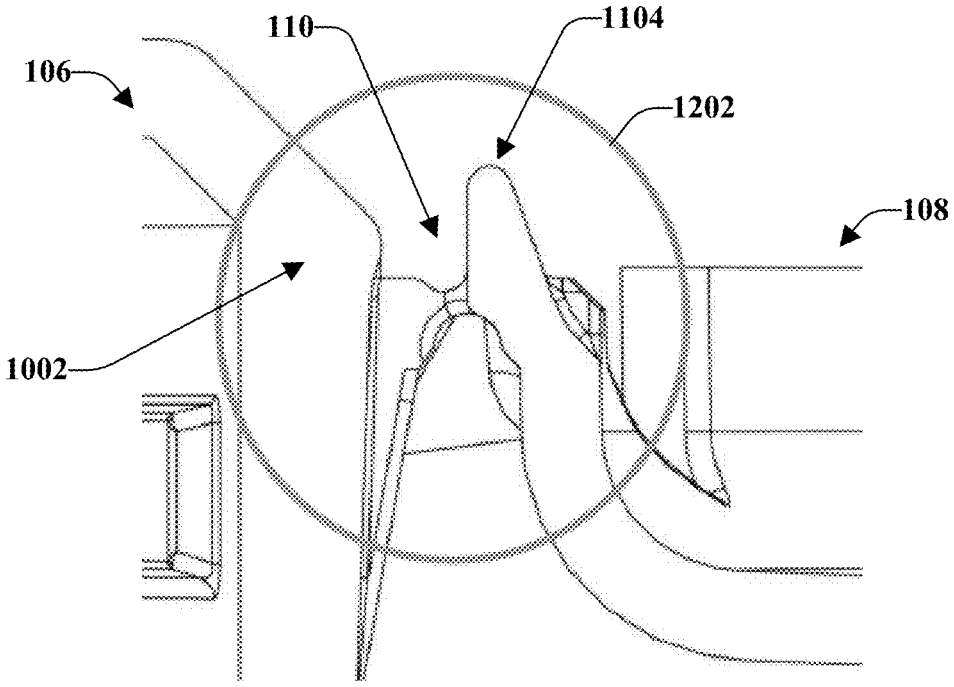
FIG. 13 illustrates an exploded view of a portion of the dispensing closure of FIG. 4, when the dispensing closure is in a full open position, according to an aspect.

As illustrated in FIG. 11, part ejection is all in the line of draw of the tooling. The stay open mechanism disclosed herein further provides the advantage of ease of removing product from the container.

As discussed the disclosed aspects relate to a closure that includes a stay open mechanism. The stay open mechanism can allow a movable portion of the closure (or lid) to be moved away from a dispensing opening of a container and remain in at least a partially open (or full open) position. The stay open mechanism can provide for ease of dispensing product from the container. In another example, the stay open mechanism can mitigate an amount of spillage of the container contents and/or less mess when dispensing a product.

FIGS. 17-21 illustrate another example, non-limiting embodiment of a closure comprising a stay open mechanism, according to an aspect. Illustrated are exploded views of a portion of the closure of FIG. 1. As previously noted, the closure 102 comprises a low profile stay open mechanism (e.g., does not substantially extend far away from the main portion of the container).

Figure 19:
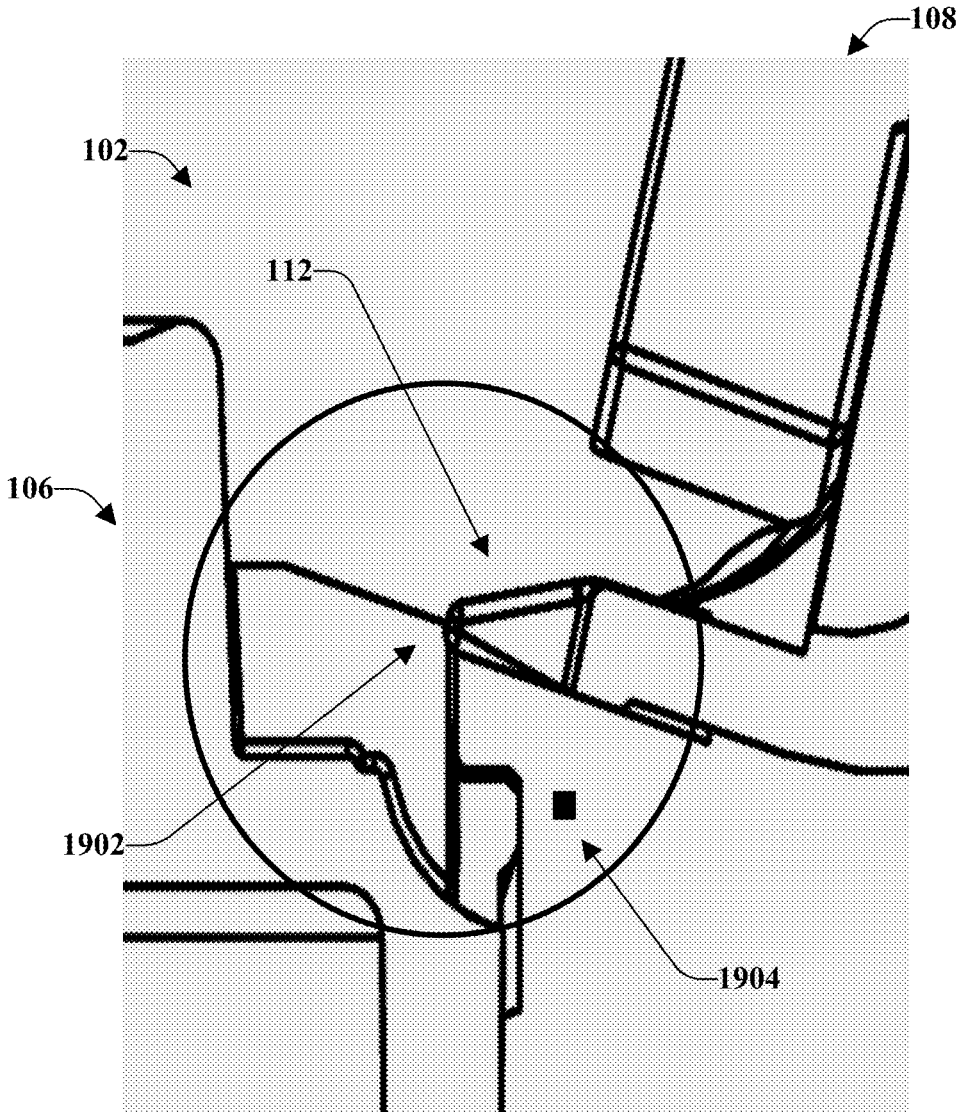
FIG. 19 illustrates a dispensing closure in an open position (or lid stop position), according to an aspect.

The body portion 106 comprises at least one first stop section 1702. The first stop section 1702 can be similar to the flex element 804 and/or the first stop section 1002 previously discussed. In an aspect, the first stop section 1702 can be configured to stop rotation of the lid portion 108 about an axis of rotation 1904 (FIG. 19). The lid portion 108 comprises at least one second stop section 1704. The second stop section 1704 can be similar to the lid stop element 806 and/or the second stop section 1004 previously discussed)

Figure 20:
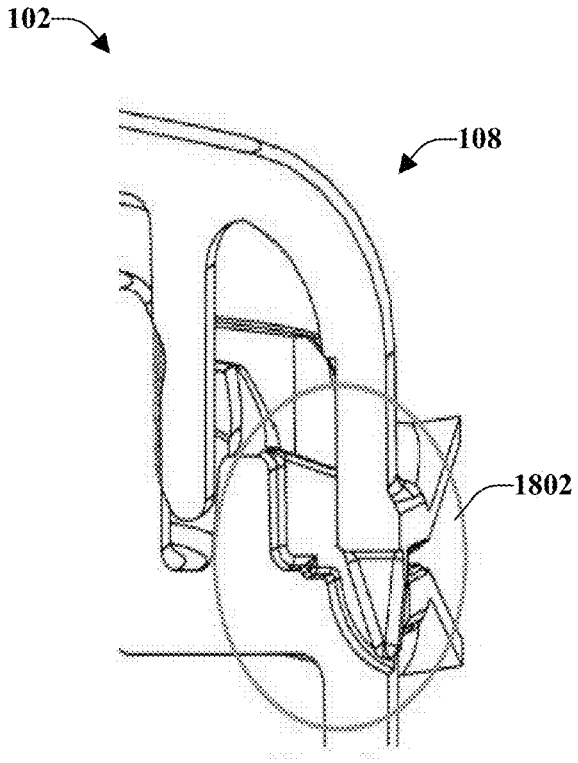
FIG. 20 illustrates an exploded view of a portion of the dispensing closure in a closed position, wherein the stop feature does not protrude when the dispensing closure is in the closed position, according to an aspect.
Figure 21:
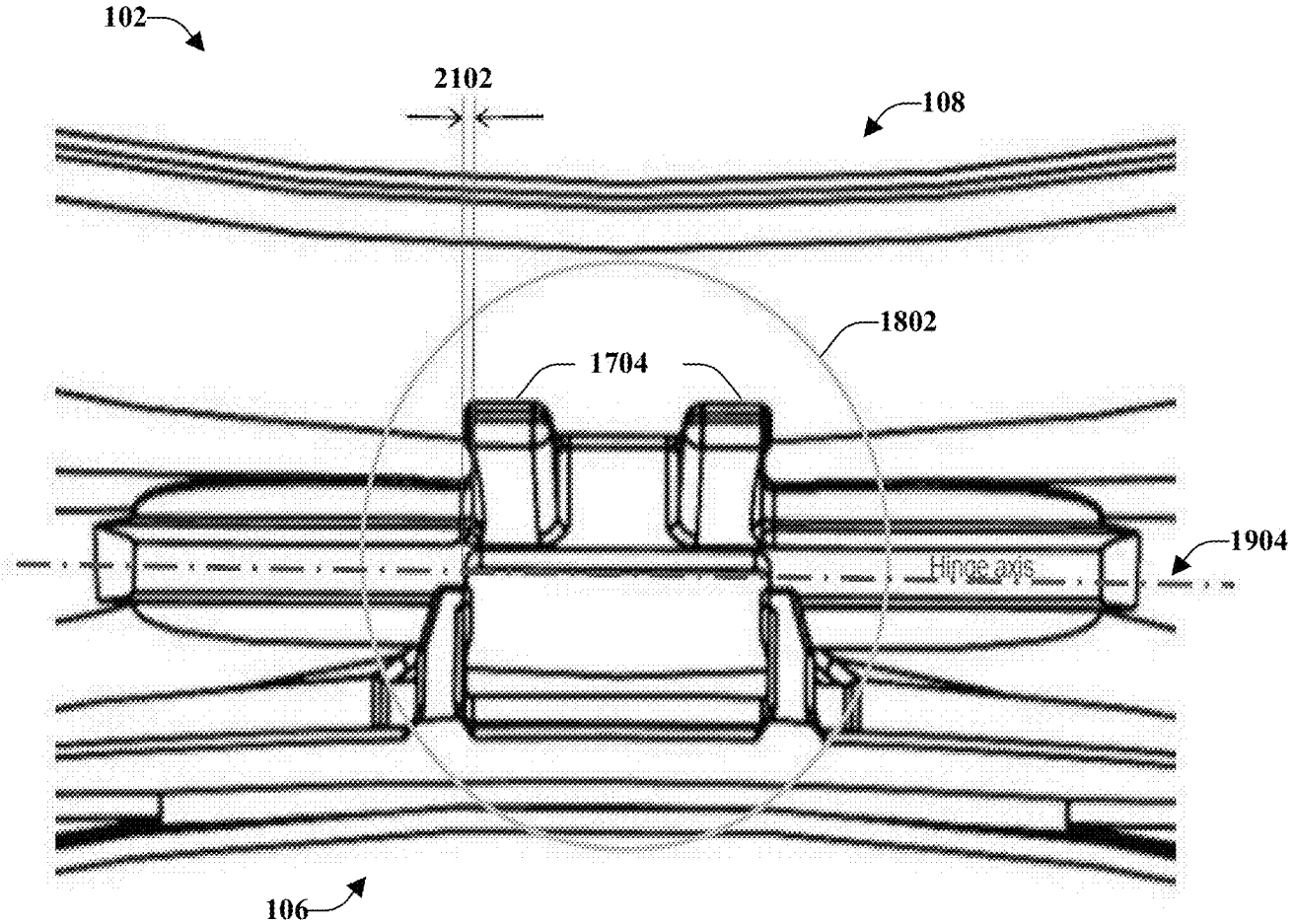
FIG. 21 illustrates an exploded view of a portion of the dispensing closure showing designed in interference, according to an aspect.

As illustrated in the figures, (where FIGS. 19-21 are exploded views of the indicated section 1802 of FIG. 18), the first stop section 1702 and the second stop section 1704 can be located adjacent the hinge 110. The second stop section 1704 can be configured to move about the axis of rotation 1904 (FIG. 19). In an aspect, the second stop section 1704 can be configured to move about the first stop section 1702 and around the axis of rotation 1904 (FIG. 19). Further to this aspect, the movement of the second stop section 1704 about the axis of rotation 1904 can create an interference with the first stop section 1702. As shown in FIG. 21, there can be designed in interference 2102 (in two places). The interference 2102 between the second stop section 1704 and the first stop section 1702 can create the designed-in interference. The interference is configured to retain the lid portion in an open position (e.g. stay open configuration).

In accordance with some aspects, engagement of the first stop section 1702 and the second stop section 1704 can be configured to retain the closure 102 (e.g., lid portion 108) in an open position (e.g., dispensing position). The engagement can be created when the lid portion 108 is moved in a first direction (e.g., in a direction away from the container and the body portion 106). In an aspect, the engagement of the first stop section 1702 and the second stop section 1704 can create interference in order to retain the lid portion 108 in the open position. According to some aspects, the engagement of the first stop section 1702 and the second stop section 1704 can create interference for dispensing product from the container. Slight force or pressure applied to the lid portion 108 in a second direction (e.g., toward the container and body portion 106) can overcome the interference. The force, applied in the second direction, can cause the lid portion 108 to rotate about the hinge axis 1904 to a closed position (FIG. 21). As illustrated in FIG. 20, when the lid portion 108 is in the closed position, the first stop section 1702 and second stop section 1704 do not protrude away from the closure 102 (e.g., outside of package).

Figure 17:
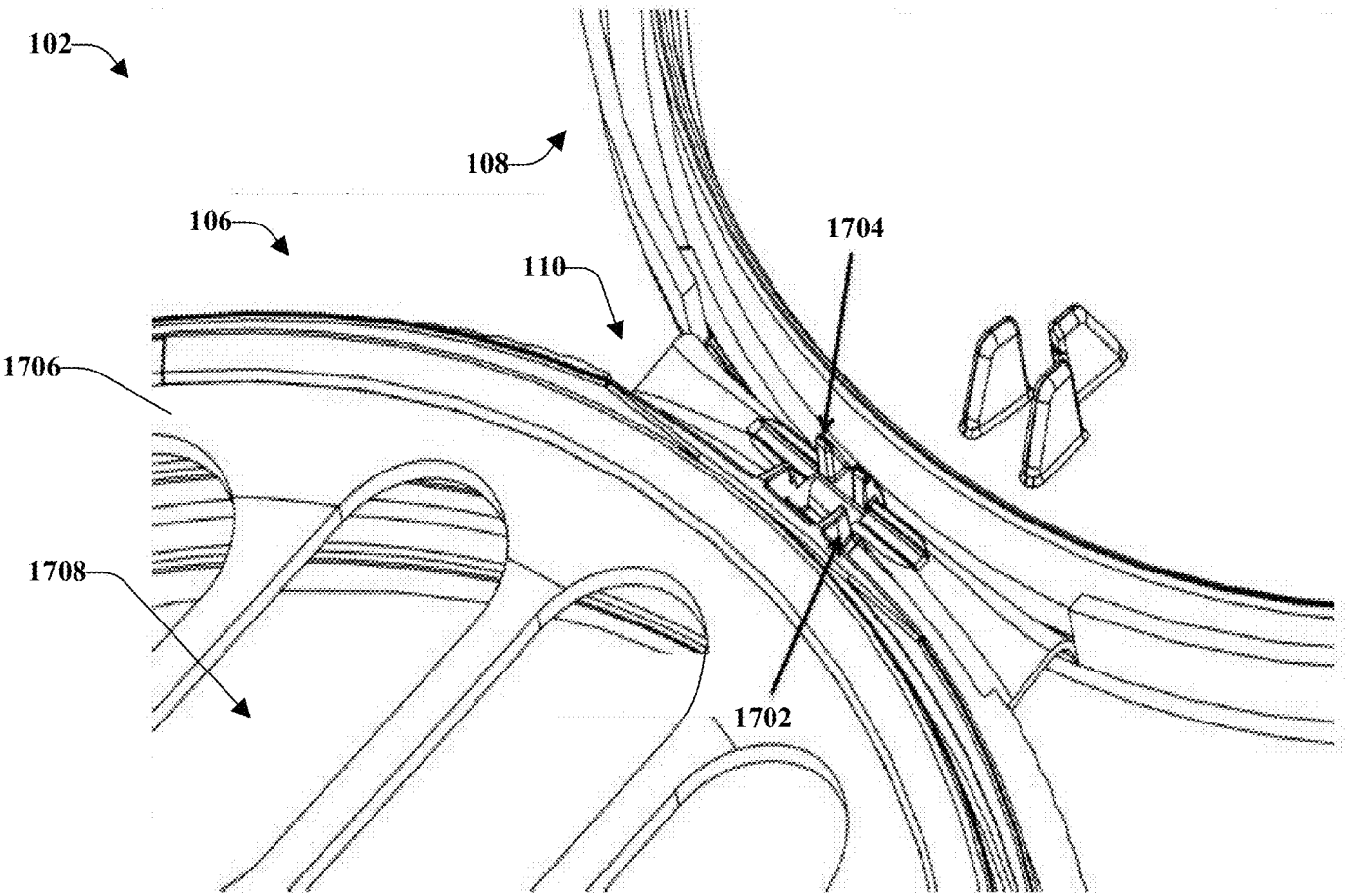
FIG. 17 illustrates an exploded view of a portion of the dispensing closure comprises one or more flex features and one or more lid stop features, according to an aspect.

In an aspect, as illustrated in FIG. 17, a slotted member or disk 1706 can be operatively engaged over an opening 1708, which corresponds with the opening or mouth of the container. The disk 1706 can have various openings or slots, which can be configured to control (or slow down) the dispensing of product from the container. In some aspects, a disk is not utilized. In other aspects, a different disk configuration can be utilized (e.g., different shaped slots or openings, different sized slots or openings, more or fewer slots or openings, and so forth).

Figure 18:
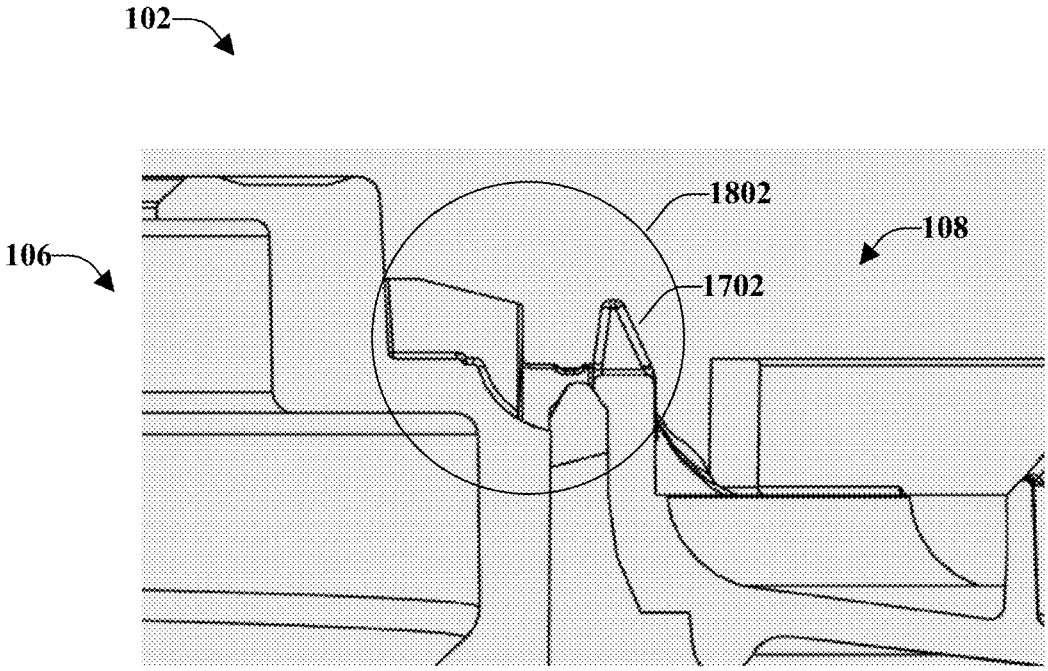
FIG. 18 illustrates an exploded view of a portion of a dispensing closure in an open position (e.g., as molded position), according to an aspect.

As illustrated in FIG. 18, the closure can be molded in an open position (e.g., lid portion is moved away from the body portion). The stay open mechanism disclosed herein further provides the advantage of ease of removing product from the container.

While the foregoing disclosure discusses illustrative aspects and/or embodiments, it should be noted that various changes and modifications could be made herein without departing from the scope of described aspects and/or embodiments as defined by the appended claims. Accordingly, described aspects are intended to embrace all such alterations, modifications, and variations that fall within the scope of the appended claims. Furthermore, although elements of described aspects and/or embodiments may be described or claimed in the singular, the plural is contemplated unless limitation to the singular is explicitly stated. Additionally, all or a portion of any aspect and/or embodiment may be utilized with all or a portion of any other aspect and/or embodiment, unless stated otherwise.

While, for purposes of simplicity of explanation, methods may be shown and described as a series of blocks, it is to be understood and appreciated that the claimed subject matter is not limited by the number or order of blocks, as some blocks may occur in different orders and/or at substantially the same time with other blocks from what is depicted and described herein. Moreover, not all illustrated blocks may be required to implement methods described herein. It is to be appreciated that functionality associated with blocks may be implemented by software, hardware, a combination thereof or any other suitable means (e.g. device, system, process, component, controller, injection molding machinery, and so on). Additionally, it should be further appreciated that methods disclosed throughout this specification are capable of being stored on an article of manufacture to facilitate transporting and transferring such methods to various devices. Those skilled in the art will understand and appreciate that a method could alternatively be represented as a series of interrelated states or events, such as in a state diagram.

To the extent that the term "includes" is used in either the detailed description or the claims, such term is intended to be inclusive in a manner similar to the term "comprising" as "comprising" is interpreted when employed as a transitional word in a claim. Furthermore, the term "or" as used in either the detailed description or the claims is intended to mean an inclusive "or" rather than an exclusive "or". That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form.

Additionally, in the subject description, the word "exemplary" (and variants thereof) is used to mean serving as an example, instance, or illustration. Any aspect or design described herein as "exemplary" is not necessarily to be construed as preferred or advantageous over other aspects or designs. Rather, use of the word "exemplary" is intended to present concepts in a concrete manner.

What is claimed is:

1. A closure, comprising:

a utensil comprising a curved portion which defines an interior and an exterior of the utensil; and a body portion configured to operatively engage a container; and a lid portion operatively attached to the body portion and in movable engagement with the body portion, the lid portion comprises a utensil retention mechanism comprising:

a first projection;

a second projection substantially parallel to the first projection, the first projection and the second projection are angled away from each other to match the curved portion of the utensil; and a third projection located at a position that is substantially parallel the first projection and the second projection and oriented in an opposite configuration than the first projection and the second projection, wherein the first projection, the second projection, and the third projection are configured to provide an interference fit with the utensil, wherein the first projection, the second projection, and the third projection each comprise at least one area that deforms when the utensil is engaged in the utensil retention mechanism;

and wherein the first projection and the second projection engage the utensil on the exterior of the curved portion and the third projection engages the utensil on the interior of the curved portion.

2. The closure of claim 1, wherein an end of the third projection is located away from respective ends of the first projection and the second projection at a distance selected as a function of a thickness of the utensil, wherein the thickness is measured between an internal portion and an external portion of the utensil.

3. The closure of claim 1, wherein each of the at least one area that deforms is configured to create respective retention forces when the utensil is engaged between the first projection, the second projection, and the third projection.

4. The closure of claim 1, the lid portion is operatively attached to the body portion with a hinge and wherein the utensil retention mechanism is positioned on an interior of the lid portion adjacent the hinge.

5. The closure of claim 1, further comprising a hinge configured to operatively attach the lid portion to the body portion, wherein the hinge comprises a flex element and a lid stop element.

6. The closure of claim 1, further comprising a flex lock comprising:

a first element located on the lid portion; and a second element located on the body portion, wherein the first element securely engages the second element and is configured to retain the lid portion in a secure position and engaged with the body portion when the closure is closed.

7. The closure of claim 1, further comprising a sift resistance element comprising a connector into which a mating element engages, and wherein the connector is a "U"-shaped member that substantially encloses at least a portion of the mating element.

8. The closure of claim 1, further comprising a stay open mechanism.

9. A container assembly, comprising:

a utensil comprising a curved portion which defines an interior and an exterior of the utensil; and a container; and a dispensing closure attachable to the container, wherein the dispensing closure comprises:

a body portion comprising a skirt configured to operatively engage the container; and a lid portion operatively attached in movable arrangement to the body portion, the lid portion comprises:

a first outward extending tab;

a second outward extending tab substantially parallel to the first outward extending tab and angled slightly with respect to the first outward extending tab, which is angled slightly with respect to the second outward extending tab so as to match the curved portion of the utensil; and a third outward extending tab offset from and facing an opposite direction than the first outward extending tab and the second outward extending tab, wherein each of the first outward extending tab, the second outward extending tab, and the third outward extending tab comprise at least one area that deforms when the curved portion of the utensil is engaged between the first, second, and third outward extending tabs.

10. The container assembly of claim 9, wherein an end of the third outward extending tab is located a distance from respective ends of the first outward extending tab and the second outward extending tab, wherein the distance is selected based on a thickness of the utensil measured with respect to an internal portion and an external portion of the utensil.

11. The container assembly of claim 9, wherein the at least one area is configured to create a retention force when the utensil is engaged between the first outward extending tab, the second outward extending tab, and the third outward extending tab.

12. The container assembly of claim 11, wherein the at least one area is configured to slightly deform when the utensil is engaged.

13. The container assembly of claim 9, wherein the lid portion is operatively attached to the body portion with a living hinge and wherein the first outward extending tab, the second outward extending tab, and the third outward extending tab are positioned on an interior of the lid portion adjacent the living hinge.

14. The container assembly of claim 9, wherein the body portion comprises a "U"-shaped member and the lid portion comprises a mating element, wherein the "U"-shaped member is configured to substantially enclose at least a portion of the mating element.

15. The container assembly of claim 9, further comprising a hinge configured to operatively attach the lid portion to the body portion, wherein the hinge comprises a flex element and a lid stop element.

16. The closure of claim 1, wherein the first projection and the second projection are configured to engage an external portion of the utensil, and the third projection is configured to engage an internal portion of the utensil.

17. The container assembly of claim 9, wherein the first outward extending tab and the second outward extending tab are configured to engage an internal portion of a utensil and the third outward extending tab is configured to engage an external portion of the utensil.

18. A closure, comprising:

a utensil comprising a curved portion which defines an interior and an exterior of the utensil; and a body portion comprising a skirt configured to operatively engage a container;

a lid portion attached to the body portion at a hinge, the lid portion being configured to move between a first position and a second position with respect to the body portion;

a utensil retention mechanism attached to the lid portion, the utensil retention mechanism comprises:

a first tab comprising a first deformable wall section that engages the exterior curved portion of a utensil;

a second tab, positioned substantially parallel to the first tab, comprising a second deformable wall section and engages a second part of the exterior curved portion of the utensil, wherein the first tab and the second tab are angled slightly away from each other; and a third tab comprising a third deformable wall section, the third tab being positioned at an orientation that is 180 degrees different than orientations of the first tab and the second tab, the third tab engages an interior curved portion of the utensil.

19. The closure of claim 18, wherein the first deformable wall section, the second deformable wall section, and the third deformable wall section are configured to create respective retention forces when a utensil is engaged between the first tab, the second tab, and the third tab.

* * * * *